United States Patent [19]

Maze

[11] 4,109,433

[45] Aug. 29, 1978

[54] BELOW ROOF VENTILATOR

[76] Inventor: Perry V. Maze, 701 Morton, Falls City, Nebr. 68355

[21] Appl. No.: 815,188

[22] Filed: Jul. 13, 1977

[51] Int. Cl.[2] ..... E04D 13/03

[52] U.S. Cl. ..... 52/199; 52/303; 98/42 A

[58] Field of Search ..... 52/199, 303; 98/37, 98/42

[56] References Cited

U.S. PATENT DOCUMENTS

| | | | |
|---|---|---|---|
| 7,177 | 6/1876 | Stephenson | 52/199 |
| 1,766,876 | 6/1930 | Busby | 98/37 |
| 2,382,076 | 8/1945 | Leslie | 98/42 |
| 2,477,152 | 7/1949 | Stevenson | 52/199 X |
| 2,771,020 | 11/1956 | Shanahan | 98/37 |
| 2,954,727 | 10/1960 | Katt et al. | 52/199 X |
| 2,973,704 | 3/1961 | Flanagan | 98/42 |
| 3,027,090 | 3/1962 | Zerhan, Jr. | 98/42 X |

FOREIGN PATENT DOCUMENTS

| | | | |
|---|---|---|---|
| 1,509,103 | 4/1969 | Fed. Rep. of Germany | 52/199 |

*Primary Examiner*—Alfred C. Perham
*Attorney, Agent, or Firm*—Thomas M. Scofield

[57] ABSTRACT

A new ventilator for spaces under slanted roofs or attics such as gable, hip and shed roof types; a ventilator using an elongate duct typically positioned between adjacent rafters under a roof, the duct inlet spaced downwardly somewhat from the ridge, the duct outlet discharging through an opening in the roof surface spaced further down from the ridge; the duct outlet configured to drain water from itself and the duct as well as protectable from winds, snow, hail, birds and the like. A like new ventilator useable under the roof panels of tanks and grain bins irrespective of the presence of rafters thereunder.

16 Claims, 8 Drawing Figures

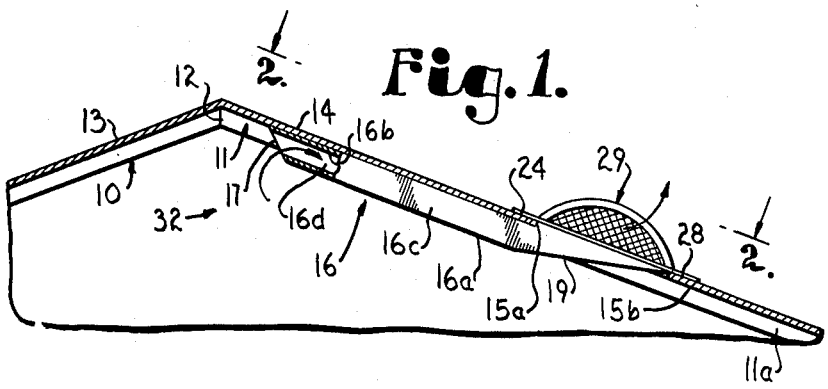
Fig. 1.
Fig. 2.
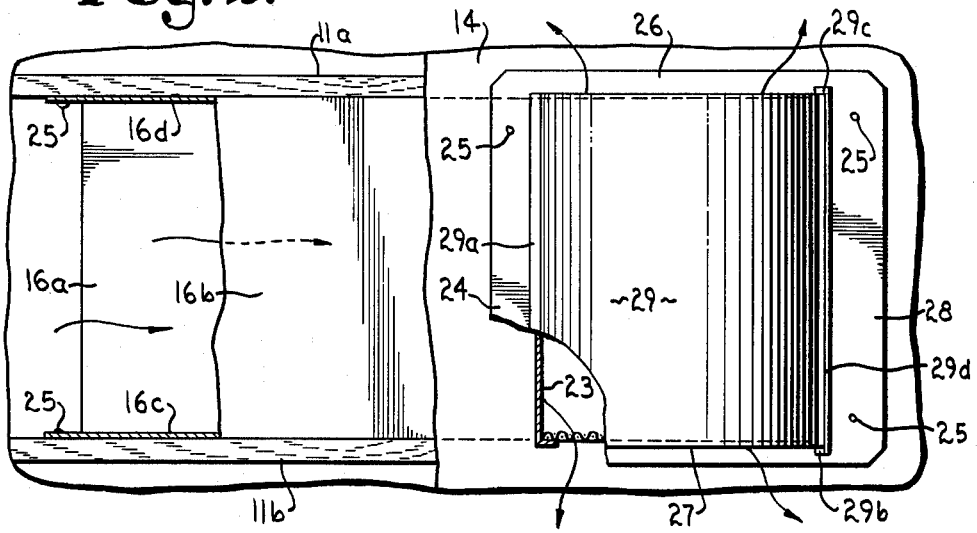
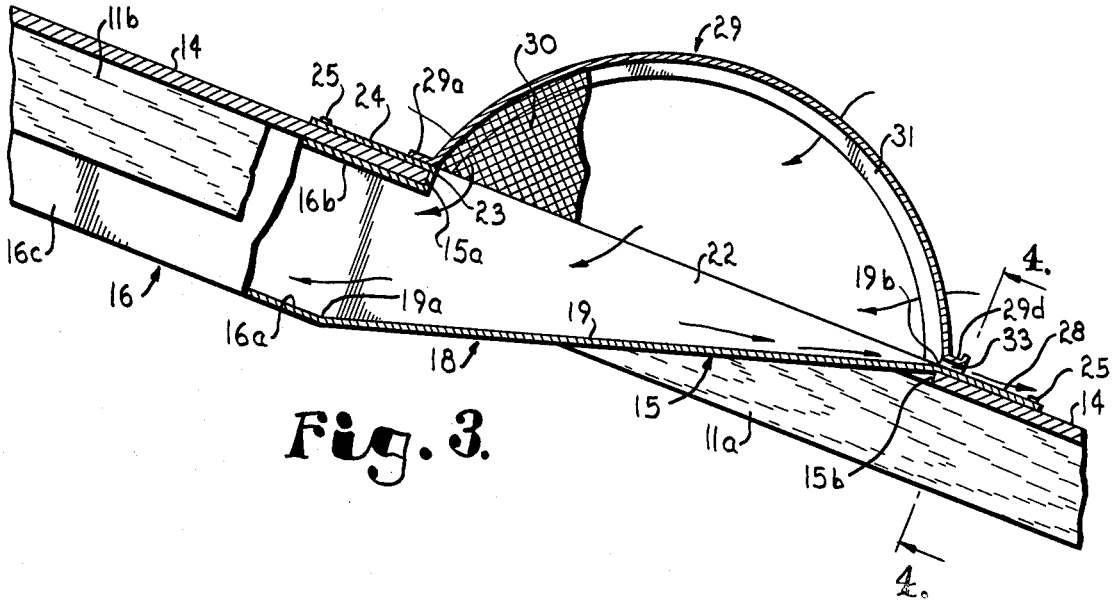
Fig. 3.

Fig. 4.
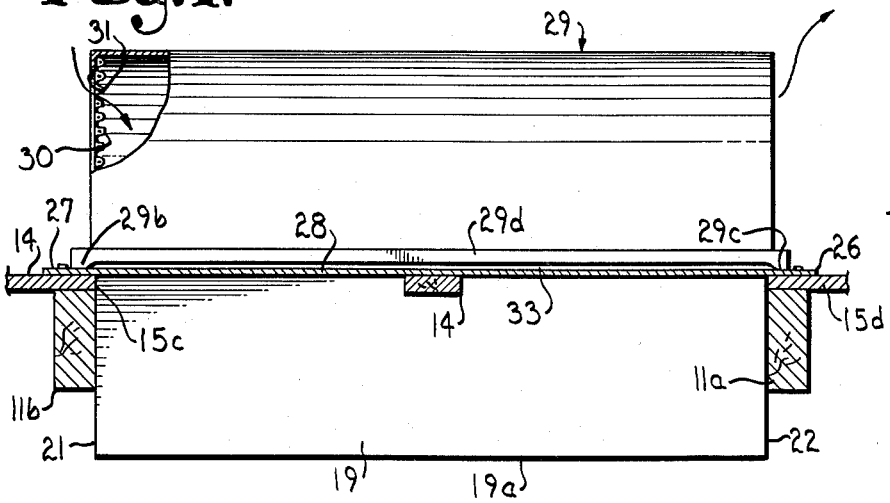
Fig. 7.
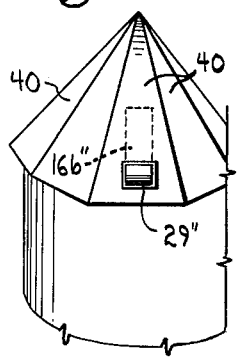
Fig. 5.
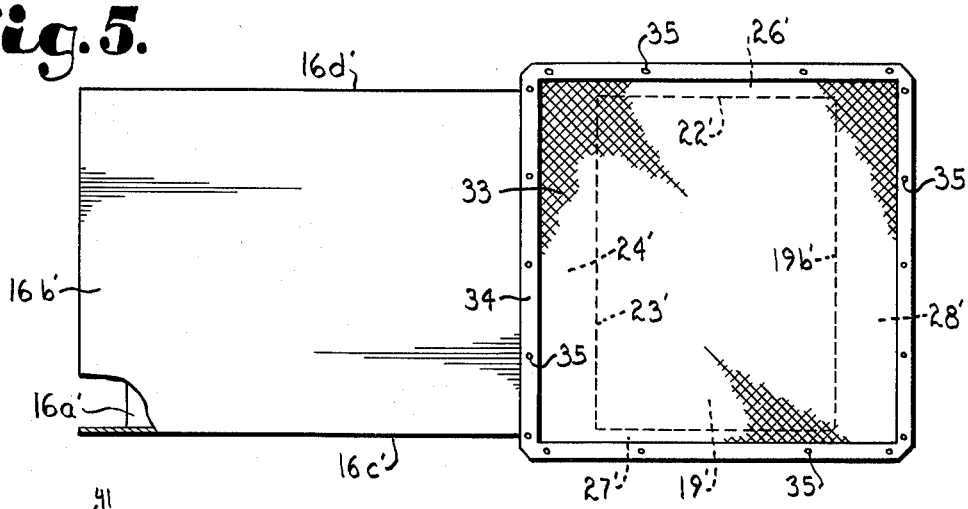
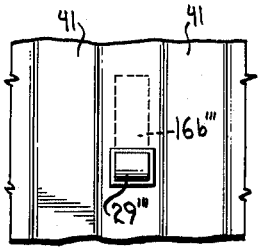
Fig. 8.
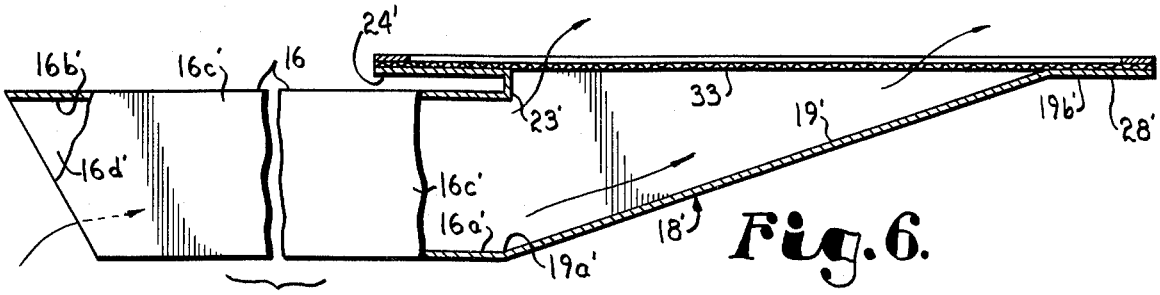
Fig. 6.

BELOW ROOF VENTILATOR

BACKGROUND OF THE INVENTION

Condensation of moisture vapor may occur in attic spaces and under flat roofs during cold weather. The most practical method of removing the moisture is by adequately ventilating the roof spaces. A warm attic that is inadequately ventilated and insulated may cause formation of ice dams at the cornice. Ventilation of the attic provides part of the answer to such problems. With a well insulated ceiling and adequate ventilation, attic temperatures are low and melting of snow over the attic space will be greatly reduced. In hot weather, ventilation of attic and roof spaces offers an effective means of removing hot air and thereby materially lowering the temperature in these spaces.

Louvered openings are commonly installed in the end walls of gable roofs for ventilation. Positive air movement in such an attic having such louvered openings can be obtained by providing openings in the soffit areas of the roof overhang, in addition to openings at the gable ends. Hip-roof houses are best ventilated by inlet ventilators in the soffit area and by outlet ventilators along the ridge. Differences in temperature between the attic and the outside create an air movement independent of the wind and also a more positive air movement when there is wind.

Types of ventilators and minimum recommended sizes have been generally established for various types of roofs. The minimum net area for attic or roof-space ventilators is usually based on the projected ceiling area of the room below.

For background information with respect to conventional roof structures and systems, as well as moisture and thermal protection in roofs, reference is made to the work "Building Construction Illustrated", author Francis D. K. Ching, 1975, Van Nostrand Reinhold Company, 450 West 33rd Street, New York City, New York 10001, particularly chapter 6 (Roof Systems) and chapter 8 (Moisture And Thermal Protection).

The subject improvement typically may be employed in shed type roofs where slopes vary from 2 in 12 to 12 in 12 and gable roofs, including low, normal and high pitch, which vary typically also from 2 in 12 to 12 in 12 with normal to high pitch being 4 in 12 to 12 in 12. In such case, typically, a wood joist and rafter construction is employed, with parallel rafters running from the lower edge of the roof to an apex or ridge for at least one side of the roof, conventionally two sides. Ridge boards are conventionally employed for gable roofs with the upper ends of the rafters connecting thereto or beam or wall supports for shed roofs. The roof surface structure supported by the rafters may be spaced wood sheathing carrying thereabove shingles or solid board or plywood sheathing carrying the shingles thereabove. The subject improvement is also useable with slate and tile roofing or metal roofing, but the formation of openings and mating of the discharge opening of the ventilator may be more difficult, depending upon the configuration of the roof material.

On the other hand, when the subject device is employed, for example, under the (typically pie shaped) roof panels of a metal grain bin, tank or the like, the requirement of but a single rectangular opening cut or formed in the roof panel makes the use of this ventilator attractive.

THE PRIOR ART

Applicant is aware of the following U.S. Pat. Nos. directed to ventilator structures and systems in buildings:

Klunder 2,350,771 "Ventilator For Buildings" issued June 6, 1944;

Farren 2,624,298 "Tile Roof Structure" issued Jan. 6, 1953;

Katt et al. 2,954,727 "Roof Ventilator" issued Oct. 4, 1960;

Joppich 2,782,464 "Ventilating Vent For Wall Of Building" issued Feb. 26, 1957;

Prager et al 3,004,483 "Clap Board Or Shingle Vent" issued Oct. 17, 1961;

Dalkas 3,323,266 "Building Including L-Shaped Tiles, Air Inlets And Air Outlets", issued June 6, 1967; and Breitwieser, et al. 3,686,813 issued Aug. 29, 1972 for "Wall Covering Defining A Continuous Ventilating Conduit".

BRIEF DESCRIPTION OF THE INVENTION (GABLE ROOFS)

The subject invention is directed to ventilator means for venting the zone beneath a gable or shed roof construction. Typically, such roof construction includes a plurality of downwardly inclined, substantially parallel, spaced-apart rafters rising to a highest roof level or ridge and supporting a roof surface structure of conventional construction. In the instant improvement, an opening of rectangular shape is provided in the roof surface construction spaced downwardly from the ridge and positioned between two adjacent rafters. This opening extends substantially from one of the two said rafters to the other and is of substantially rectangular shape, preferably.

An elongate duct which is of a width preferably substantially that of the distance between the two said adjacent rafters is positioned therebetween underneath the roof surface structure and above the opening. The duct is preferably of substantially rectangular cross-sectional shape transversely. The upper open end of the duct is spaced downwardly from the underside of the roof ridge (preferably approximately 2 feet) so that air from the zone under the roof surface structure adjacent the ridge may enter into the upper end of the duct. The lower end of the duct extends substantially downwardly between the two rafters to the upper edge of the roof surface construction opening. A wedge-form discharge trough is positioned within the roof surface opening of substantially inverted right triangle configuration in longitudinal axial section. This trough has a substantially rectangular flat bottom wall which is connected at its upper end to the bottom wall of the duct and has its lower end overlying the lower edge of the roof surface structure opening. Thus this flat bottom wall underlies in its length the said roof surface structure opening. Two side walls of the discharge trough are of substantially inverted right triangle configuration and connected at their lower edges to the side edges of the trough bottom wall. The upper edges of the trough side walls extend out the roof surface opening closely adjacent the side edges thereof. Thus the wedge-form discharge trough formed by the noted three walls fills the roof surface opening and completely underlies it.

A flashing is preferably provided circumferentially around the wedge-form discharge trough which includes as its upper extremity the lower end of the top wall of the duct. This flashing overlies the roof surface structure surrounding the roof surface structure opening. The flashing thus supports the lower end of the duct and the discharge trough. A few nails into the upper duct side walls 16*c* and 16*d* secure the length of the duct under the roof surface structure between the two rafters with the lower end of the assembly carried by the flashing on the outer roof structure surface.

Suitable screening is provided (against hail and birds) across the ventilator discharge opening. Insect screening may also be used. A domed outlet cover optionally may be provided running at right angles to the longitudinal axis of the duct with screen protection at both ends. In such case, water drainage means is provided along the lower wall of the dome.

OBJECTS OF THE INVENTION

A first object of the invention is to provide an improved ventilator for gable and shed type roofs of houses and house-like constructions, and additionally, for metal tank and grain bin like structures.

Another object of the invention is to provide such an improved ventilator wherein the major portion thereof is sheltered beneath the roof surface structure, same optionally received or supported between two adjacent rafters in the case of gable and shed type roofs.

Another object of the invention is to provide such an improved ventilator which is simple in structure, easy to manufacture, relatively cheap, dependable in service and having a long life of continuous use.

Another object of the invention is to provide such a beneath-roof ventilation construction which substantially aids in reducing or removing problems of attic space ventilation including condensation of moisture vapor, and formation of ice dams at cornices and other places in cold weather, as well as removal of hot air from attic and roof spaces in hot weather.

Another object of the invention is to provide such an improved ventilator construction which is extremely easy to install and wherein all of the parts thereof are readily available for inspection, replacement or repair, if needed.

Another object of the invention is to provide such a beneath-roof ventilator construction which requires only an opening or hole in a gable or shed type roof spaced downwardly from the ridge between two rafters for immediate insertion thereof, as well as permanent installation. The same is true for installation of the subject device into and under inclined metal panel roofs as in tanks and grain bins.

Another object of the invention is to provide such a ventilator for such mentioned type roofs which fits and works efficiently in substantially any pitch of roof except in a flat roof.

Another object of the invention is to provide efficient, effective, continuous venting of the below-roof or attic space, yet additionally always provide ample protection of the attic or below-roof space and prevention of intrusion of outside element pressure, hail, rain, snow or the like.

Another object of the invention is to provide such a below-roof ventilator which is adequately screenable against leaves, birds and insects in all its forms.

Another object of the invention is to provide a below-roof ventilator construction which can be fabricated to any width desired to accommodate any rafter spacing to be encountered while still giving the same effective ventilation per square inch of area. The same is true with respect to roof panel area available with respect to metal structures such as grain bins.

Another object of this invention is to furnish a unit or ventilator that is virtually water proof if it is correctly installed and sealed as in the normal course of roofing.

Other and further objects of the invention will appear in the course of the following description thereof.

In the drawings, which form a part of the instant specification and are to be read in conjunction therewith, embodiments of the invention are shown and, in the various views like numerals are employed to indicate like parts.

FIG. 1 is a fragmentary transverse section through the ridge and upper portion of the roof of a conventional house structure of the gable type showing the preferred form of the vent mounted therewithin.

FIG. 2 is a view taken along the lines 2—2 of FIG. 1 in the direction of the arrows with portions of the roof surface structure and the ventilator itself cut away to better illustrate the ventilator construction and its positioning and engagement with respect to the roof structurals.

FIG. 3 is an enlarged, partly sectional detail of the lower right hand portion of the ventilator of FIG. 1, particularly showing the discharge trough and air escape dome thereover, as well as the engagement of the lower end of the ventilator with the roof surface construction.

FIG. 4 is a view taken along the line 4—4 of FIG. 3 in the direction of the arrows.

FIG. 5 is a vertical plan view from above of a modified form of the subject improved below-roof ventilator construction.

FIG. 6 is a side and partly sectional view of the device of FIG. 5, enlarged, with the central portion of the duct not shown, whereby both ends of the ventilator of FIGS. 5 and 6 are seen.

FIG. 7 is a fragmentary perspective view from above of a grain bin roof having one of the subject ventilators installed therein.

FIG. 8 is a view like FIG. 7 of a portion of a metal roof made up of rectangular panels having the subject ventilator installed therein.

STRUCTURE AND FUNCTION

Referring first to FIG. 1, therein is schematically shown the upper portion of a gable type roof wherein two sets of upwardly inclined rafters 10 and 11 (generally designated) meet at the apex or ridge of the roof and connect at their upper ends to a ridge board 12 or the like. In the instant showing, the roof surface covering shown comprises plywood sheeting 13 (above rafters 10) and 14 (above rafters 11). The shingles to be applied above the plywood sheeting are not seen, it being assumed that this is a house in the process of construction with the roof not yet completed. In actuality, as previously noted, other roof surface constructions could be employed, of conventional type.

Referring to FIG. 2, two of the rafters 11 are shown, underneath roof surface 14, designated, respectively, 11*a* and 11*b*. While the pitch of the roof shown is relatively shallow, a steeper pitch roof will also permit the use of the improved ventilator construction to be described. A flat roof cannot use the subject improvement.

A rectangular or square hole or opening generally designated 15 is provided in the roof surface structure 14 spaced downwardly from the roof ridge board 12 preferably at least 2 feet further than the length of the duct to be described. Said otherwise, the inlet opening of the upper end of the duct is preferably spaced downwardly at least 2 feet from the roof ridge board 12. Opening 15 has upper edge 15*a*, lower edge 15*b* (FIG. 3) and side edges 15*c* and 15*d* (FIG. 4). The side edges of opening 15 are preferably substantially at the rafters 11*a* and 11*b* (the inboard faces thereof) and extend parallel therewith. The edges 15*a* and 15*b* are preferably normal to edges 15*c* and 15*d* and rafters 11*a* and 11*b*.

The upper portion of the ventilator duct is generally designated 16 with bottom wall 16*a*, top wall 16*b* and side walls 16*c* and 16*d*. The transverse cross-sectional configuration of duct 16 is preferably rectangular. The upper wall 16*b* extends from the upper edge 15*a* of opening 15 to a position preferably substantially 2 feet down, at least, from ridge board 12. Lower wall 16*a* may extend from approximately even with the lower end of upper wall 16*b* or slightly thereabove (FIG. 3) to a position somewhat below upper wall 16*b* to provide an inlet opening 17 at the upper end of the duct fully open to flow of air from the attic ridge zone into duct 16.

The lower discharge end of duct 16 is provided with a wedge form discharge trough which preferably underlies at least substantially all of the opening 15 and some times slightly more area upwardly thereof as seen in FIG. 3. The wedge form discharge trough is generally designated 18 and has a substantially rectangular, flat bottom wall 19 which connects at its upper end 19*a* to bottom wall 16*a* of duct 16 and at its lower end 19*b* overlies the lower edge 15*b* of opening 15 in roof surface 14. Thus, bottom wall 19 underlies the entire opening 15 and, in the form seen in FIG. 3, a slight portion of the upper wall 16 of duct 16*b*.

The wedge form discharge trough 18 also has two side walls of substantially inverted right triangle configuration 21 and 22 (FIG. 4). The side walls are connected at their lower edges to the side edges of the trough bottom wall 19 and have their upper edges extending out through opening 15 at least to the top thereof and preferably positioned closely adjacent the side edges 15*c* and 15*d* of the opening 15 as is seen in FIG. 4.

There must be, in the roof slope with which the ventilator construction being described is employed, some fall in the orientation of bottom wall 19 from top edge 19*a* to bottom edge 19*b* in order that any water accumulating within the duct or the wedge shaped discharge trough will be drained from the ventilator. From the previous description, it may be seen that the wedge shaped discharge trough, comprising bottom wall 19 and side walls 21 and 22, completely underlies the entire opening 15 and, additionally, connects to the bottom wall 16*a* of duct 16 and side walls 16*c* and 16*d* thereof. Additionally, walls 21 and 22 of wedge shape discharge trough 18 are of slightly greater height than duct walls 16*c* and 16*d* for a purpose to be described.

In order that the subject ventilator construction may be firmly secured and sited with respect to opening 15, at the lower end of top wall 16*b* of duct 16, there is provided a short flange or wall 23 which runs the length of wall or edge 15*a* of opening 15. Connected thereto and running back over the top of wall 16*b* of duct 16 is flange 24 which, in combination with the lower end of wall 16*b*, flange 23 and itself, form an open ended sleeve whereby to embrace the edge 15*a* of opening 15. Nails 25 or other conventional fasteners may be employed to secure flange 24 to underlying roof surface construction 14. Flanges 26 and 7 are connected at their inboard ends to the top edges of walls 21 and 22 and overlie roof surface construction 14 next to the walls 21 and 22. Finally, flange 28 is connected to the lower end 19*b* of bottom wall 19 of the wedge shaped trough, whereby to overlie roof surface construction 14 below the lower wall or edge 15*b* of opening 15. Thus it may be seen that a continuous skirting of flanges 24, 26, 27 and 28 surround and are connected to walls or flanges 23, 21, 19*b* and 22, whereby the said wedge shaped discharge trough and the lower end of duct 16 are configured to feed air (and any water therein) out over the roof surface construction 14.

[Optimally, the upper flanges 24, 26 and 27 overlie the roof sheeting, while the lower flange 28, which cooperates in drainage function, overlies the roof shingles.]

In the structure of FIGS. 1–4, inclusive, there is provided an arcuate dome generally designated 29 which is positioned with its longitudinal axis at right angles to the longitudinal axis of duct 16, being fixed to wall or flange 24 by flange 29*a* and, at the lower ends thereof, to flange 28 by spacer blocks 29*b* and 29*c*. The lower or right hand flange 29*d* (FIG. 3) is spaced upwardly from flange 28 and bottom wall portion 19*b* a fraction of an inch to permit discharge of water between flange 29*d* and bottom wall portion 19*b* and flange 28.

Screens 30, which are connected to flanges 31 interior of dome 29, serve to keep out hail, birds and leaves. At their lower ends, screens 30 are abutted against or connected to flanges 26 and 27.

INSTALLATION

With respect to installation of the device of FIGS. 1–4, inclusive, as previously noted, there merely has to be provided, in a house under construction, a suitable opening 15 between two rafters 11*a* and 11*b* in the roof surface structure 14, preferably before same is shingled. With the opening provided, of the proper size (width from inside face of rafter to inside face of rafter and length equal to the distance from wall 23 to end wall portion 19*b*), the operator need only insert the end of duct 16 opposite from that having the wedge shaped discharge trough thereon through the opening and upwardly under the roof surface construction 14 between rafters 11*a* and 11*b*. When the duct has been inserted all the way under the roof, with the wedge shaped trough seated under opening 15 (with flanges 24, 27, 28 and 26 surrounding opening 15 on the outer or upper face of roof surface construction 14), suitable fasteners or nails 25 may be driven through flanges 24, 27, 28 and 26, or at least flanges 24 and 28, and also through duct side walls 16*c* and 16*b* at the upper end of duct 16 into the rafters. If desired, one or more nails or fasteners may be driven through openings provided in or through upper duct wall 16*b* adjacent the upper end thereof. These fasteners or nails securely fix the duct, the wedge shaped discharge trough and the exterior flanges in place with respect to the roof surface construction 14 and rafters 11*a* and 11*b*.

OPERATION

In operation, when the air pressure in the attic zone 32 adjacent the ridge 12 exceeds the outside air pressure, air will be forced into the upper end of duct 16 and out through the discharge trough 18, then through screens 30 at the sides of arcuate dome or channel 29. After the ventilator is inserted, the roof may be shingled therearound. If the ventilator is being inserted in an already shingled roof, the shingles around the opening 15 zone must be removed, the opening provided, the ventilator inserted and then the area and zone reshingled.

Preferably, a bird screen is placed over the end openings of arcuate dome 29 as seen at 30. If a bug screen is required (finer mesh), it is installed over the bird screen 30.

In the event that rain, snow or the like, under extraordinary circumstances, is blown into the wedge shaped discharge trough zone or even partly up into duct 16, the downward slopes of the duct and the bottom wall 19 discharge the water through the slot 33 which is preferably of approximately 3/8 inch opening.

For a standard 24 inch center rafter spacing, the ventilator would be 21½ inches wide at the main area with a 6 inch depth, giving approximately 129 square inches of ventilation area per unit of this size. In another example, for 16 inch center rafter spacing, the ventilator would be 13½ inches wide at the main body area with a 6 inch depth, or approximately 81 square inches of ventilation area per unit of this size. The units can be made to any width to accommodate any rafter spacing desired and still give the same effective ventilation per square inch of area.

The hood 29 area height or size is provided in substantially direct relationship to the square inch area of relief area from the ventilator proper. Thus, for larger units, dealing with commercial area spacing requirements, the hood area would be larger to give adequate relief area in comparison to unit relief area in the smaller units.

Since the outlet or escape area represented by the two screened openings at the ends of arcuate hood 29 is so small in relation to the attic area, outside element pressure tends to have little or no effect against the heat and attic air pressure operating to escape in the duct. The soffets or other air inlets in the attic (conventionally at the circumferential base of the roof) should be equal in area to the evacuation square inch area provided by the ventilators for most effective operation.

FIGS. 5 AND 6

Turning to FIGS. 5 and 6, therein is shown a modified form of ventilator which is identical in all ways with the ventilator of FIGS. 1–4, inclusive, save with the difference that the arcuate dome or hood 29 is omitted. Accordingly, parts of the ventilator which are identical in structure to the device of FIGS. 1–4, inclusive are numbered the same, but primed. Additionally, these parts will not be again described, because their structure is identical and their installation in the roof structure of roof surface construction, rafters and opening is also identical to the device already shown and described.

The construction of FIGS. 5 and 6 differs from that of FIGS. 1–4, inclusive in that a bird screen 33 is laid over flanges 24', 27', 28' and 26' and removably secured thereto by a square or rectangular frame 34 which is secured to each of the said flanges by conventional fasteners 35 engaging frame 34 and the respective flanges.

The main advantage to use of the construction of FIGS. 5 and 6 is the fact that the ventilator discharge opening is flush with the roof or substantially so, whereby to be less visible than the arcuate dome 29 or hood 29. There is not, however, as much weather protection in the structure of FIGS. 5 and 6 as is provided by that of FIGS. 1–4, inclusive.

For additional reference, see the publication "Wood Frame House Construction", author L. O. Anderson, Agricultural Handbook Number 73, published by the U.S. Department of Agriculture, 1975 Revision.

With respect to gable and shed type roofs, a range of pitch from 2–12 to 7–12 covers 90 percent of the types of roofs. The ventilators described and shown in the drawings are optimally operative in these pitch ranges. For steeper roof pitches, the inlet duct would typically be shortened. Thus, if the roof pitch is substantially steeper than 7–12, the duct length may be cut approximately in half. This would result in the opening through the roof surface being moved upwardly on the roof surface, as the optimum spacing of the upper inlet opening from the apex of the roof is preferably of minimum of 2 feet to 3 feet from the apex. The amount of duct section removed, as the pitch steepens, depends on the relative steepness of the pitch of the roof. Shortening the duct limits the vertical distance the inside air must be forced by inside pressure.

Preferably, the area of the outlets on each side of the dome 29 in FIGS. 1–3, inclusive is greater than the inlet area to the duct. The same is true with respect to the device of FIGS. 4–6, inclusive with the exception that there is but a single air outlet surface, rather than one divided between the two sides of the dome.

In the construction of FIGS. 1–3, the hood over the evacuation opening not only gives a cover for the attic relief area and a convenient base for bird and bug screen application, but also serves as a up-and-over shield over the relief opening against wind, rain, snow and the like. It also serves, in most wind directions, as a barrier against the outside elemental action which would otherwise compete against attic air condensation and other elements trying to escape from the attic.

Typically, with respect to roof thickness for these units, they may be standardized for ½ inch thick material. When other sheeting thicknesses are employed, they may be revised to special order.

It is extremely important to stress that the unit, properly installed, is water proof and will not leak water into the construction which is being ventilated.

Two of these units for 16 inch rafter spacing will adequately ventilate 1000 square feet of floor space. This means that only two holes are cut into the roof, these not leaking, compared to numerous holes required for other smaller units. Yet further, two of these units for 24 inch rafter spacing takes care of larger houses (for example 1500 square feet).

Thus there has been provided a new housing attic ventilator having design simplicity, water proof construction and structural strength. This ventilator works on any pitch roof (subject to revision of duct length on high pitch roofs) and is not restricted to housing alone. It may be used for chicken, hog houses, grain bins, metal tanks and the like. The device uses free flow escape of air, moisture and heat from the attic or roof zone, when the attic pressure build up. There is no requirement of man-made energy.

After the basic installation is completed, which requires only a few minutes time, the roofing is finished right around the unit, making it completely waterproof. Only the hood area is left visible, which is the basic heat and air escape area.

Typical dimensions for the device of FIGS. 4–6, inclusive could be the following. With respect to the duct, the side walls 16c' and 16d' 6 inches in height. Wall 16a' 33 inches in length and wall 16b' 36 inches in length. Inclined wall 18' 21¼ inches. The length of the opening between flange 23' and wall 19b' 20¼ inches. The width of the circumferential flanges around the opening 4 inches. The width of the opening, as well as the width of the duct 22½ inches. With these basic measurements defined, the dimensions of the arcuate hood in FIGS. 1–3 would be proportionate to the corresponding measurements recited. (height approximately 7 inches)

In the event that the device of FIGS. 5 and 6 is used in houses, buildings or grain bins, a hood of flat sheet metal or such with downwardly curved upper and lower ends may be employed, mounted spaced upwardly on and from flange 34 as a weathershield. Interior baffles may alternatively be used to limit air and water flow into the duct due to extreme rain, wind or storm conditions.

FIGS. 7 & 8

The purpose of the showing of FIGS. 7 and 8 is to demonstrate that the subject ventilator is not necessarily limited to application in a conventional house roof construction between rafters. Thus, FIG. 7 shows the device of FIGS. 3–6, inclusive installed in the roof of a construction analogous to a conventional cylindrical grain bin. The roof members in this case are triangular or pie segment shapes 40 which join in a common, essentially point apex at the center top of the roof. The duct may be installed anywhere along the length of the pie shaped segements up to the apex, so long as the upper portion of the duct is receivable within the approaching edges of the roof segment. Here the roof segments are designated 40 with the parts of the duct numbered the same as in FIGS. 1–3, inclusive, but double primed.

FIG. 8 shows a like installation in a metal roof where the roof panels are essentially rectangular in shape. Again, it is not necessary that adjacent rafters be provided. These panels are typically U-shaped in transverse section with the adjacent flanges fastened, one to the other, in conventional fashion. Again, the parts of the ventilator are numbered the same as in FIGS. 3–6, but triple primed. The rectangular metal roof panels are numbered 41.

All that is required for installation in metal roofs of the type seen in FIGS. 7 and 8 is that an opening be provided within the roof panel which will carry the ventilator, with suitable fasteners securing the upper duct wall 16b' to the underside of the metal roof panel or therethrough in water sealing fashion. The spacing between the flanges 24 and 16b or 24' and 16b' (FIGS. 3 or 6) would be readjusted to a lesser thickness, preferably, for this type of roof member.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. In a roof construction including a plurality of downwardly inclined, substantially parallel, spaced-apart rafters supporting a roof surface structure which rises to a highest roof level or ridge, ventilator means for venting the zone beneath the roof surface construction, comprising, in combination:

the roof surface construction having an opening therethrough and therein spaced downwardly from said ridge, said opening positioned between two adjacent rafters, extending substantially from one of said rafters to the other, laterally, and being of substantially rectangular shape, an elongate duct of a width substantially that of the distance between the two said adjacent rafters positioned and closely fitting therebetween under the roof surface structure above said opening, said duct of substantially rectangular transverse cross-sectional shape, the upper, open end of said duct spaced downwardly from the underside of the roof ridge so that air from the zone under the roof surface structure adjacent the ridge may enter the upper end of the duct, the lower end of the duct extending substantially to the upper edge of the roof surface opening, and a wedge-form discharge trough positioned within the roof surface opening of substantially inverted right triangle configuration in longitudinal axial section, said trough having a substantially rectangular bottom wall connected at its upper end to the bottom wall of the duct and having its lower end overlying the roof surface opening lower edge, whereby to underlie in its length the said roof surface opening, and two side walls of substantially inverted right triangular configuration connected at their lower edges to the side edges of the trough bottom wall and having their upper edges extending out the said roof surface opening closely adjacent the side edges thereof, whereby the said wedge-form discharge trough formed by the said three walls fills the said roof surface opening and completely underlies same, and means fixing said duct and trough under said roof surface, between said rafters and within and under said roof surface opening, whereby air entering the upper end of the duct under pressure will travel downwardly within said duct and out said trough.

2. Ventilator means as in claim 1 including screen means across the roof surface opening connecting to the walls of the wedge-form discharge trough and the upper wall of the duct.

3. Ventilator means as in claim 1 including the upper end of the lower wall of the duct ending short of the terminus of the upper wall of said duct to facilitate the entry of air into the upper end of said duct.

4. Ventilator means as in claim 1 including circumferential flashing provided overlying the roof surface construction circumferential to the roof surface construction opening and the lower end of said duct and said wedge-form discharge trough, said flashing connecting to the lower end of the upper wall of the duct, the upper edges of the trough side walls and the lower end of the trough bottom wall.

5. Ventilator means as in claim 4 including screen means connecting to said flashing and covering said opening and discharge trough.

6. Ventilator means as in claim 4 including an arcuate dome covering said opening and discharge trough and connected at its upper and lower ends to the flashing above and below said opening and said discharge trough and screen means in the ends of said dome connecting to the flashing at the lateral sides of of said roof surface opening, the axis of said dome being at substantial right angles to the axis of said duct.

7. Ventilating means as in claim 6 including the lower edge of said dome spaced upwardly from the lower flashing at the lower side of said roof surface opening to permit water drainage.

8. In a roof construction including a plurality of downwardly inclined, adjacent positioned panel members making up together a roof having a relatively elevated apex or ridge, ventilator means for venting the zone beneath the roof and under the panels comprising, in combination:

at least one of said panels having an opening therethrough and spaced downwardly from said apex or ridge, said opening positioned within the area of the said panel member and being of substantially rectangular shape, an elongate duct of a width no greater than that of the distance between the panel member edges (in the area of the panel carrying the duct) closely fitting under the roof and panel, said duct of substantial rectangular transverse cross-sectional shape, the upper, open end of said duct spaced downwardly from the underside of the roof apex or ridge so that air from the zone under the roof adjacent the apex or ridge may enter the upper end of the duct, the lower end of the duct extending substantially to the upper edge of the panel opening, and a wedge-formed discharge trough positioned within the roof and panel opening of substantially inverted right triangle configuration and longitudinal axial section, said trough having a substantially rectangular bottom wall connected at its upper end to the bottom wall of the duct and having its lower end over lying the roof surface opening lower edge, whereby to underlie in its length the said roof surface opening, and two side walls of substantially inverted right triangular configuration connected at their lower edges to the side edges of the trough bottom wall and having their upper edges extending out the said roof surface opening closely adjacent the side edges thereof, whereby the said wedge-form discharge trough formed by the said three walls fills the said roof surface opening and completely underlies same, and means fixing said duct and trough under said roof and panel member and within and under said roof and panel opening, whereby air entering the upper end of the duct under pressure will travel downwardly within said duct and out said trough.

9. A roof construction as in claim 8 wherein the panel members are triangular in configuration joining together at a central apex.

10. A roof construction as in claim 8 wherein the panel members are substantially rectangular in configuration, joining together at an elongate roof ridge.

11. Ventilator means as in claim 8 including screen means across the roof surface discharge opening connecting to the walls of the wedge-form discharge trough in the upper wall of the duct.

12. Ventilator means as in claim 8 including the upper end of the lower wall of the duct ending short of the terminus of the upper wall of said duct to facilitate entry of air into the upper wall of said duct.

13. Ventilator means as in claim 8 including circumferential flashing provided overlying the roof and panel circumferential to the panel opening, as well as the lower end of said duct and said wedge-form discharge trough, said flashing connecting to the lower end of the upper wall of the duct, the upper edges of the trough side walls and the lower end of the trough bottom wall.

14. Ventilator means as in claim 13 including screen means connecting to said flashing and covering said opening and discharge trough.

15. Ventilator means as in claim 13 including an arcuate dome covering said opening and discharge trough and connected at its upper and lower ends to the flashing above and below said opening and said discharge trough, and screen means in the ends of said dome connecting to the flashing at the lateral sides of said roof surface opening, the axis of said dome being at substantial right angles to the axis of said duct.

16. Ventilating means as in claim 15 including the lower edge of said dome spaced upwardly from the lower flashing at the lower side of said roof surface opening to permit water drainage.

* * * * *